US006467704B2

(12) United States Patent
Sahai et al.

(10) Patent No.: US 6,467,704 B2
(45) Date of Patent: Oct. 22, 2002

(54) NOZZLE FOR GUIDING MOLTEN METAL

(75) Inventors: Yogeshwar Sahai, Powell, OH (US); Shuchi P. Khurana, Columbus, OH (US)

(73) Assignee: Foseco International Limited, Swindon (GB)

( * ) Notice: Subject to any disclaimer, the term of this patent is extended or adjusted under 35 U.S.C. 154(b) by 18 days.

(21) Appl. No.: 09/725,711

(22) Filed: Nov. 30, 2000

(65) Prior Publication Data

US 2002/0063172 A1 May 30, 2002

(51) Int. Cl.[7] ..... B05B 1/14
(52) U.S. Cl. ..... 239/553.5; 239/590.5
(58) Field of Search ..... 239/553, 553.5, 239/518, 524, 552, 556, 568, 590, 561, 590.5, 504, 597–599; 222/590, 604, 606, 607

(56) References Cited

U.S. PATENT DOCUMENTS 5,205,343 A 4/1993 Streubel et al.
5,402,993 A 4/1995 Hofmann et al.
5,603,860 A 2/1997 Hohenbichler
5,673,857 A 10/1997 Meroni et al.
5,785,880 A 7/1998 Heaslip et al.
5,944,261 A * 8/1999 Heaslip et al. ..... 239/553.5
6,027,051 A 2/2000 Heaslip et al.
6,341,722 B1 * 1/2002 Tolve et al. ..... 222/594

* cited by examiner

*Primary Examiner*—Lisa A. Douglas
(74) *Attorney, Agent, or Firm*—Nixon & Vanderhye

(57) ABSTRACT

A nozzle for guiding molten metal flowing from a vessel into a mould, the nozzle comprising a conduit which is elongate along an axis which is oriented substantially vertically during use, the nozzle having at least one upper inlet, at least two lower outlets which are inclined to the axis, and at least one lower outlet located generally axially between the inclined outlets, the minimum combined cross-sectional area of the inclined outlets being at least twice as great as the minimum combined cross-sectional area of the one or more generally axially located outlets.

29 Claims, 5 Drawing Sheets

NOZZLE FOR GUIDING MOLTEN METAL

BACKGROUND AND SUMMARY OF THE INVENTION

The present invention relates to a nozzle for guiding molten metal, for example molten steel. More particularly, the invention relates to a so-called submerged entry nozzle, sometimes also known as a casting nozzle, used in the continuous casting process for producing steel. The invention also relates to a method of guiding molten metal using the nozzle.

In the continuous casting steelmaking process, molten steel from a ladle is poured into a large vessel known as a tundish. The tundish has one or more outlets through which the molten steel flows from the tundish into one or more respective moulds in which the molten steel cools and solidifies to form continuously cast solid lengths of the metal. A submerged entry nozzle, which has the general form of an elongate conduit (it generally has the appearance of a rigid pipe or tube) is located between the tundish and each mould, and guides molten steel flowing through it from the tundish to the mould.

The main functions of the ideal submerged entry nozzle are as follows. Firstly, the nozzle serves to prevent the molten steel from coming into contact with air as it flows from the tundish into the mould, since air would cause oxidation of the steel, which is undesirable. Secondly, it is highly desirable for the nozzle to introduce the molten steel into the mould in as smooth and non-turbulent a manner as possible, since turbulence in the mould causes the flux on the surface of the molten steel in the mould to become dragged down into the steel (known as "entrainment"), thereby generating impurities in the cast steel. Turbulence in the mould also disrupts the lubrication of the sides of the mould: one of the functions of the mould flux (apart from preventing the surface of the steel from coming into contact with air) is to lubricate the sides of the mould to prevent the steel adhering and solidifying to the mould and to prevent the consequent formation of surface defects in the cast steel. Minimizing the turbulence by means of the submerged entry nozzle is therefore important for this purpose also. Additionally, turbulence can cause stress on the mould itself, risking damage to the mould. Furthermore, turbulence in the mould can also cause uneven heat distribution in the mould, consequently causing uneven soldification of the steel and also causing variations in the quality and composition of the steel being cast. This latter problem also relates to a third main function of the submerged entry nozzle, which is to introduce the molten steel into the mould in an even manner, in order to achieve even solidified shell formation (the steel solidifies most quickly in the regions closest to the mould walls) and even quality and composition of the cast steel. A fourth function of an ideal submerged entry nozzle is to reduce or eliminate the occurrence of oscillations in the standing wave in the meniscus of steel in the mould. The introduction of molten steel into the mould generally creates a standing wave at the surface of the steel, and any irregularities or oscillations in the flow of the steel entering the mould can give rise to oscillations in the standing wave. Such oscillations can have a similar effect to turbulence in the mould, causing entrainment of mould flux into the steel being cast, disrupting the effective lubrication of the sides of the mould by the mould flux, and adversely affecting the heat distribution in the mould.

It will be appreciated that designing and manufacturing a submerged entry nozzle which performs all of the above functions as well as possible is an extremely challenging task. Not only must the nozzle be designed and manufactured to withstand the forces and temperatures associated with fast flowing molten steel, but the need for turbulence suppression combined with the need for even distribution of the molten steel in the mould create extremely complex problems in fluid dynamics.

U.S. Pat. No. 5,785,880 discloses nozzles in which the bottom outlet is divided into two ports by means of a flow divider. This design of nozzle is claimed to diffuse and decelerate the molten steel flow, and is also claimed to provide a generally uniform flow velocity distribution along the length and width of the outlet ports. This design of nozzle, it is claimed, has the consequence of reducing the size of oscillations in the standing wave in the meniscus of steel in the mould.

U.S. Pat. No. 5,944,261, which is a continuation-in-part of U.S. Pat. No. 5,785,880, discloses a submerged entry nozzle in which each of the two outlet ports is itself divided into two by means of a baffle, in such a way that the largest proportion of the molten steel flow throughput exits the nozzle via the two central ports. The particular shape and positioning of the baffles is claimed to diffuse the central streams and to cause recombination of the central streams with their respective outer streams upon exiting the nozzle. The consequence of this is claimed to be a reduction in the velocity of the molten steel exiting the nozzle, and a reduction in the turbulence created in the mould.

U.S. Pat. No. 6,027,051, which is a continuation-in-part of U.S. Pat. No. 5,944,261, discloses a variation on the design disclosed in U.S. Pat. No. 5,944,261, in which it is claimed that the effective discharge angle of the outer streams of molten steel varies depending upon the flow throughput. It is claimed that this has the effect of providing a smooth, quiescent, meniscus, over a range of flow throughputs.

One of the conclusions which will be most readily drawn from a consideration of the above patents is that seemingly minor, or even seemingly insignificant, changes in the design of a submerged entry nozzle can have dramatic effects upon the flow pattern of the molten steel flowing through, and out of, the nozzle. This is a consequence of the chaotic nature of fluid dynamics, in which small design changes to a conduit transporting a fluid can have profound effects upon the fluid flow pattern, and can even alter the nature of the fluid flow entirely.

The present invention seeks to provide a submerged entry nozzle which performs, as well as possible, the main functions of the ideal nozzle referred to above. The invention seeks to achieve this objective in a way which is entirely contrary to the teaching of the patents mentioned above, as will be explained below.

According to a first aspect, the invention provides a nozzle for guiding molten metal flowing from a vessel into a mould, the nozzle comprising a conduit which is elongate along an axis which is oriented substantially vertically during use, the nozzle having at least one upper inlet, at least two lower outlets which are inclined to the axis, and at least one lower outlet located generally axially between the inclined outlets, the minimum combined cross-sectional area of the inclined outlets being at least twice as great as the minimum combined cross-sectional area of the one or more generally axially located outlets.

The first aspect of the invention has the advantage that because the minimum combined cross-sectional area of the inclined outlets is at least twice as great as the minimum combined cross-sectional area of the one or more generally axially located outlets, the proportion of all of the molten metal flowing through the nozzle which flows out of the inclined outlets is generally significantly greater than the proportion which flows out of the generally axially located outlets. Preferably, at least 55% of the total molten metal flow exits the inclined exits and no more than 45% of the total molten metal flow exits the generally axially located outlets; more preferably, at least 60% of the total flow exits the inclined exits and no more than 40% of the total flow exits the generally axially located outlets. Because of the inclination to the vertical, of the inclined outlets, the downward vertical component of the velocity of the molten metal exiting such outlets is smaller than would be the case for vertically oriented outlets.

This has the effect of reducing the downward velocity of the majority of the metal entering the mould, and consequently reducing the turbulence created in the mould.

This is entirely contrary to U.S. Pat. No. 5,944,261 and U.S. Pat. No. 6,027,051, which teach that a greater proportion of the entire molten metal flow should flow through the lower (central) exit ports than through the upper (outer) exit ports, and in particular, 55–85% of the flow should exit the central ports and 15–45% of the flow should exit the outer ports.

The outlets which are inclined to the axis of the nozzle (i.e. the "outer" or "side" outlets) may be substantially perpendicular to the nozzle axis, or they may be upwardly inclined (with the nozzle oriented as during use) with respect to the nozzle axis, for example. Preferably, however, the inclined outlets are downwardly inclined (with the nozzle oriented as during use) with respect to the nozzle axis. More preferably, the inclined outlets are downwardly inclined at an angle of 40°–60° to the nozzle axis, even more preferably at an angle of 45°–55° to the nozzle axis, for example approximately 50° to the nozzle axis.

The or each outlet located generally axially between the inclined outlets preferably widens towards the exit of the outlet. This has the advantage of decreasing the velocity of the molten metal exiting the outlet, thereby decreasing the impact of the molten metal in the mould, and minimizing the turbulence created in the mould.

In some preferred embodiments of the invention, there are at least two (and preferably only two) outlets located generally axially between the inclined outlets, and preferably both (or all) such outlets widen towards their exit. For embodiments in which there are two such outlets, they are preferably located symmetrically on opposite sides of the nozzle axis.

The axis of the or each generally axially located outlet may be substantially coaxial with, or substantially parallel to, the axis of the nozzle. It is more preferred, however, at least for embodiments in which there is a plurality of generally axially located outlets, for the axis of each such outlet to be inclined with respect to the nozzle axis. Advantageously, the outlets may be downwardly inclined to the nozzle axis at an angle of 0°–30° to the axis, more preferably at 5°–25° to the axis, especially at 10°–20° to the axis, for example at approximately 15° to the axis.

Preferably the orientation and spacing of the inclined outlets and the generally axially located outlets is such that the molten metal streams exiting the generally axially located outlets during use do not combine with the molten metal streams exiting the inclined outlets (other than by the general mixing of all of the molten metal within the mould).

The minimum cross-sectional area of each outlet is as-measured perpendicular to the respective axis of the outlet, and the minimum combined cross-sectional area, respectively, of the inclined and the generally axially located outlets, is a combination of each of these measurements. As already mentioned, the minimum combined cross-sectional area of the inclined outlets is at least twice as great as the minimum combined cross-sectional area of the one or more generally axially located outlets. Preferably, the minimum combined cross-sectional area of the inclined outlets is at least three times as great, more preferably at least four times as great, as the minimum combined cross-sectional area of the one or more generally axially located outlets.

In preferred embodiments of the first aspect of the invention, at least the inclined outlets of the nozzle have a substantially constant cross-sectional area (perpendicular to their respective axes) along at least part of their length. In especially preferred embodiments, the inclined outlets have a restriction substantially at their innermost extremity, beyond which (in a direction towards their outermost extremity) the bore of each inclined outlet is wider. Beyond the restriction (where present), the bore of each inclined outlet is preferably substantially constant in cross-sectional area.

A second aspect of the invention provides a nozzle for guiding molten metal flowing from a vessel into a mould, the nozzle comprising a conduit which is elongate along an axis which is oriented substantially vertically during use, the nozzle having at least one upper inlet, and having at least two lower outlets which are inclined to the axis, the nozzle further comprising a receptacle located substantially axially between the inclined outlets, the receptacle having an upper opening and being defined by sidewalls which are substantially parallel and/or which converge towards the lower extremity of the nozzle, the receptacle receiving a proportion of the molten metal flowing through the nozzle in use prior to such molten metal exiting the nozzle.

The second aspect of the invention has the advantage that the receptacle located in the nozzle (which receives a proportion of the molten metal flowing through the nozzle prior to such molten metal exiting the nozzle) acts generally as a buffer which dampens oscillations or fluctuations in the flow rate of the molten metal flowing through the nozzle. This has the effect of reducing (or even, at least in some circumstances, substantially eliminating) the fluctuations or oscillations in the flow rate of the molten metal which exits the nozzle and enters the mould, thus reducing the likelihood of oscillations in the standing wave in the meniscus of steel in the mould. This consequently has the advantage that the likelihood of the entrainment of mould flux into the steel being cast, the disruption of the lubrication of the mould, and poor heat distribution in the mould, all of which can be caused or exacerbated by oscillations in the standing wave, are generally significantly reduced.

The dampening effect of the receptacle in the nozzle is created by the substantially axial location of the receptacle together with the shape of the receptacle, i.e. its substantially parallel and/or converging sidewalls. Because the receptacle is substantially axially located between the inclined outlets, it normally receives the full force of a significant proportion of the molten metal flowing through the nozzle, and because of its parallel and/or converging sidewalls, the receptacle generally absorbs a significant proportion of the momentum of the molten metal which it receives. In some embodiments of the invention, the receptacle may contain one or more outlets through which some of the molten metal flowing through the nozzle may exit the nozzle; in other embodiments the receptacle contains no such outlet and is entirely closed except for its upper opening. In either case, however, the effect of the receptacle is such that molten metal flowing out of the receptacle and into the inclined outlets does so in a generally consistent fashion, and such molten metal flowing out of the receptacle may also influence molten metal flowing directly into the inclined outlets from the elongate conduit of the nozzle, dampening variations in the flow rate of this part of the metal flow. Additionally, for those embodiments of the invention in which the receptacle itself contains one or more nozzle outlets, the molten metal exiting these outlets normally also has variations in its flow rate dampened. Both the concept and the practice of the nozzle receptacle according to the second aspect of the invention are entirely contrary to the teaching of U.S. Pat. No. 5,944,261 and U.S. Pat. No. 6,027,051, in which the baffles provided to divide the flow of liquid metal into outer and inner streams have diverging lower faces in order to diffuse the lower stream.

The receptacle is preferably defined by four sidewalls. Advantageously, at least two of the sidewalls converge towards the lower extremity of the nozzle, and more preferably all of the sidewalls so converge. Two opposite sidewalls of the receptacle are preferably provided by sidewalls of the nozzle itself; the other two sidewalls are preferably provided by structures located within the nozzle. Most preferably, the latter two sidewalls are provided by structures which also provide restrictions in the inclined outlets, as referred to above with respect to the first aspect of the invention.

In the most preferred embodiments of the invention, the first and second aspects of the invention are combined in one and the same nozzle.

Preferably, the receptacle is located above two generally axially located outlets. Two converging sidewalls of the receptacle are preferably provided by structures which define divisions between respective inclined outlets and generally axially located outlets.

The nozzle according to the invention is formed from refractory material. The refractory material preferably comprises ceramic material, for example a carbon-bonded ceramic material. Carbon-bonded ceramic materials are very well known in the art, and the skilled person will be able to select suitable materials for forming nozzles according to the present invention. The nozzle is preferably formed by isostatic pressing, which is the conventional technique for forming carbon-bonded ceramic articles.

A third aspect of the invention provides a method of guiding molten metal flowing from a vessel into a mould, utilizing a nozzle according to the first aspect of the invention.

A fourth aspect of the invention provides a method of guiding molten metal flowing from a vessel into a mould, utilizing a nozzle according to the second aspect of the invention.

BRIEF DESCRIPTION OF THE DRAWINGS

The invention will now be described, by way of example, with reference to the accompanying drawings, of which.

DETAILED DESCRIPTION OF THE DRAWINGS

Figure 1:
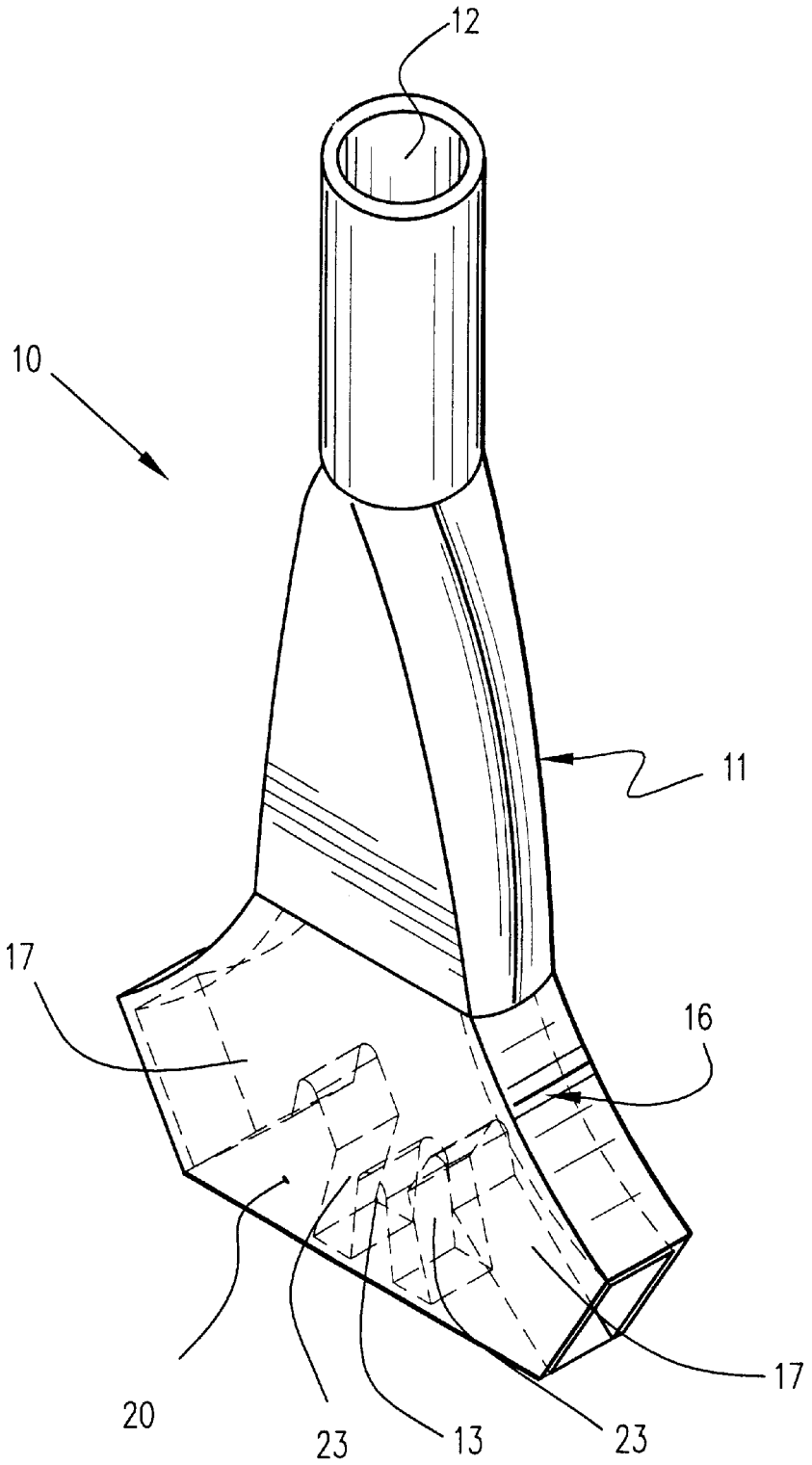
FIG. 1 is a schematic isometric view of a nozzle according to the present invention.

The figures show a nozzle 10 according to the invention, the nozzle comprising a conduit 11 which is elongate along an axis which is oriented substantially vertically during use, the nozzle 10 having an upper inlet 12, two lower outlets 17 which are inclined to the axis, and two lower outlets 23 which are located generally axially between the inclined outlets 17. The minimum combined cross-sectional area of the inclined outlets is approximately four times as great as the minimum combined cross-sectional area of the generally axially located outlets 23. Located above the generally axially located outlets 23, and located substantially axially between the two inclined outlets 17, is a receptacle 45. The receptacle 45 has an upper opening 21 and is defined by sidewalls 14 and 36 which converge towards the lower extremity 13 of the nozzle. The receptacle 45 receives a proportion of the molten metal flowing through the nozzle in use prior to such molten metal exiting the nozzle 10.

The nozzle 10 comprises, in essence, three sections. An upper section of the nozzle has the form of a substantially circular cross-section tube, terminating at its uppermost extremity in the inlet 12. Below the upper section, a middle section 11 is flared outwardly in one plane parallel to the nozzle axis, and flattened in an orthogonal plane. Below the middle section 11 is a lower section 16, comprising the outlets 17 and 23 and the receptacle 45.

Figure 3:
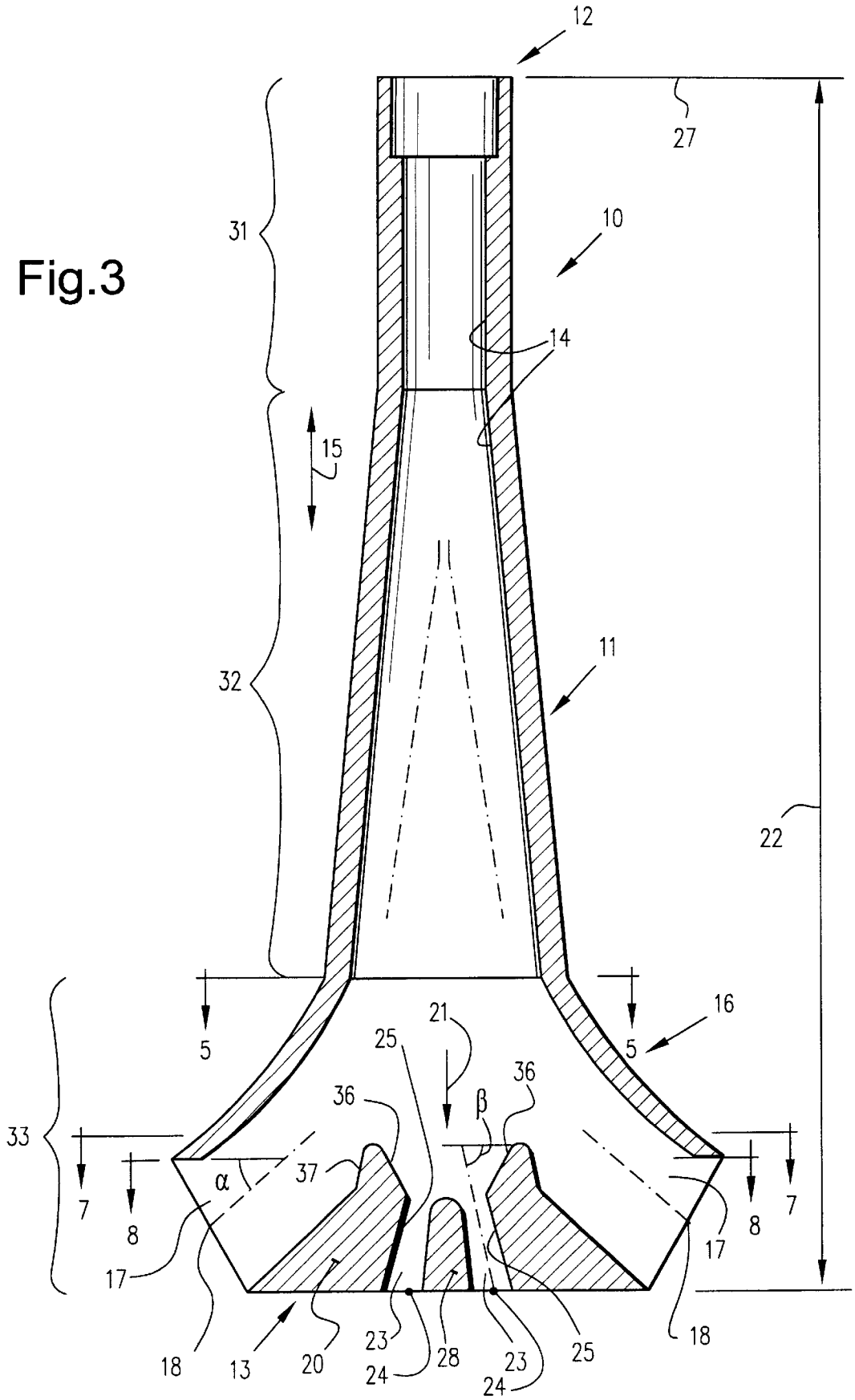
FIG. 3 is a longitudinal cross-sectional view taken along line 3—3 of FIG. 2.

The conduit 11 is flared outwardly adjacent the bottom, as shown generally by reference numeral 16, to define two outer discharge outlets 17, each having a discharge center point 18, and an imaginary center line passing through the imaginary center point 18 making an angle a with respect to the horizontal, as seen in FIG. 3.

The angle a preferably is about 35–45°, and the converse of the angle a (the angle of the center line with respect to the dimension of elongation 15) is about 45–55°.

The nozzle 10 also comprises a structure, shown generally by reference numeral 20, between the outer discharge outlets 17, which defines a receptacle shown generally by reference numeral 45. The receptacle 45 has sufficient volume, and is so shaped and positioned, that it stabilizes the flow of molten metal discharged from the outlets 17 (and other outlets to be hereafter described). For example, for an embodiment where the total length 22 of the nozzle 10 is about 20–30 inches, the receptacle 45 may have a volume of between about 1–2 cubic inches.

The nozzle 10 also comprises at least one, and preferably two, outlets 23 in the bottom 13, each having a discharge center point 24, and at least one molten metal transporting passage 25 extending from the receptacle 45 to each of the outlets 23, two such passages 25 being illustrated in FIG. 3.

The two passages 25 are preferably formed by a divider 28 (see FIG. 3) and the structures 20. The divider 28 and the structures 20 define the passages 25 so that they diverge outwardly from the longitudinal dimension 15, e.g. so that imaginary center lines through the center points 24 thereof make an angle b with respect to the horizontal of about 70–80° (and conversely an angle with respect to the longitudinal dimension 15 of about 10–20°). Preferably the angles b and a differ by at least about 30°, and the nozzle 10 is otherwise constructed so that the streams of molten metal discharged from the outer outlets 17 do not mix (before all the streams are diffused in the mould) with the streams discharged through the outlets 23.

While the element 13 can be made separate from the conduit 11, preferably it is integral therewith, e.g. all the components molded of the same refractory material.

Figure 2:
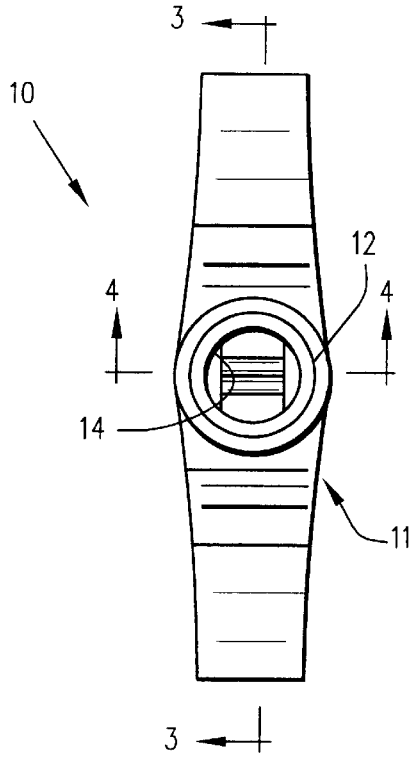
FIG. 2 is a top plan view of the nozzle of FIG. 1.
Figure 5:
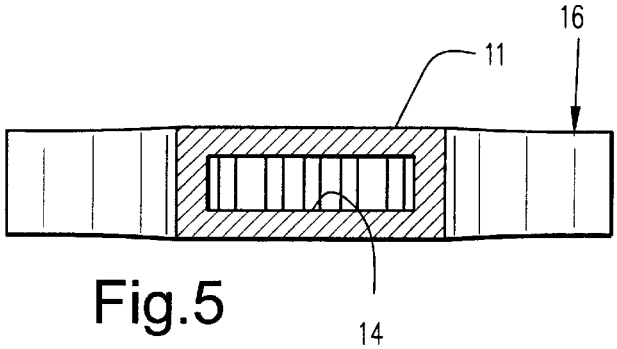
FIG. 5 is a cross-sectional view taken along lines 5—5 of FIG. 3.
Figure 4:
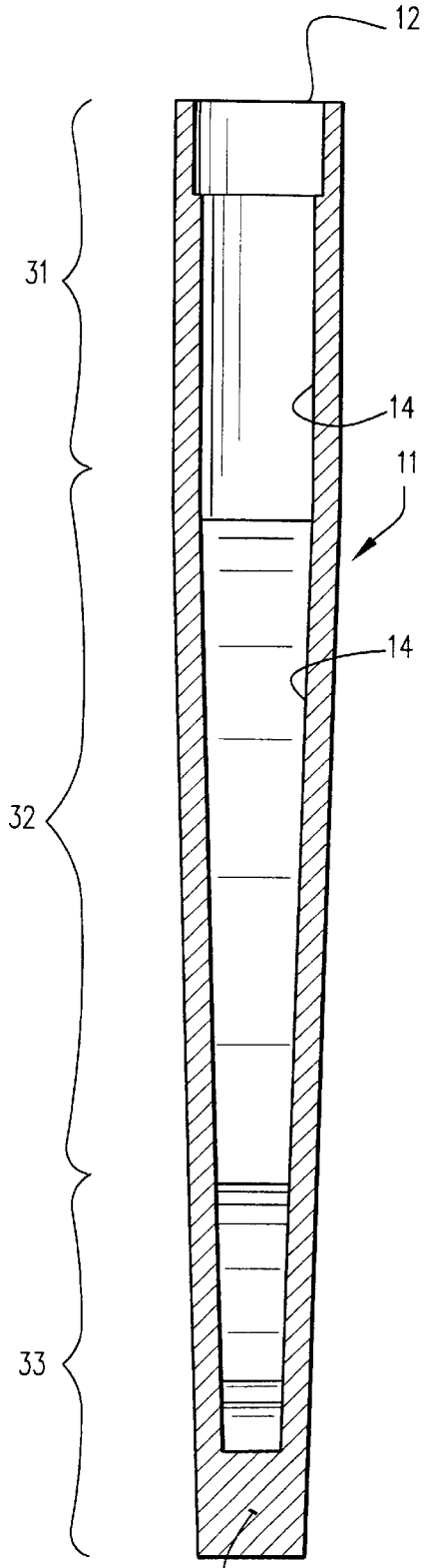
FIG. 4 is a cross-sectional view taken along lines 4—4 of FIG. 2.
Figure 6:
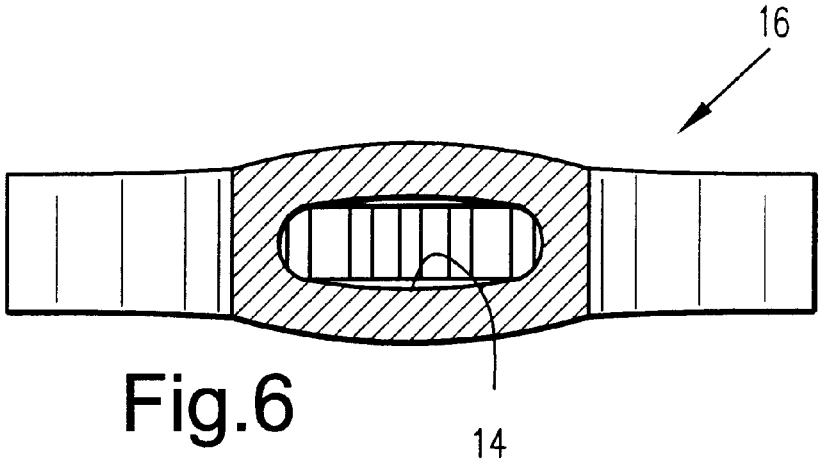
FIG. 6 is a view like that of FIG. 5 only showing a different configuration of the passageway.

In order to enhance the effectiveness of the nozzle 10, preferably it has a construction, such as generally shown in U.S. Pat. No. 5,205,343 and 5,402,993, and German patent publications 195 05 390 and 43 19 195, where there is a geometry change between the top 12 and the central portion of the passageway 14, and an increase in cross-sectional dimension. That is, there may be a first portion 31 of the conduit 11 which has, as seen in FIGS. 2 and 3, a substantially circular cross section, and a second portion 32 (see FIGS. 3 and 4) having a larger cross-sectional area for the passageway 14 than for the first section 31 and having a different cross-sectional area. For example, as illustrated in FIG. 5 passageway 14 in the second portion 32 may have a substantially rectangular cross section, or as illustrated in FIG. 6 the passageway 14 may have a substantially oval (including racetrack) configuration. The third portion 33 (see FIGS. 3 and 4) of the nozzle 10 contains the outwardly flared portion 16 of the conduit 11 adjacent the bottom 13.

Figure 7:
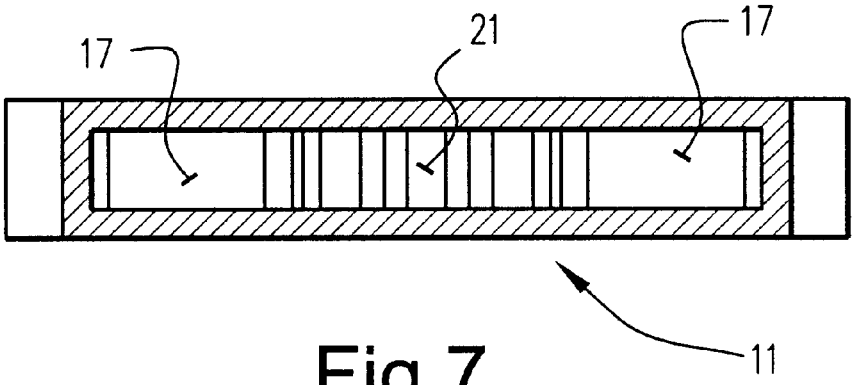
FIGS. 7 and 8 are cross-sectional views taken along lines 7—7 and 8—8, respectively, of FIG. 3.
Figure 8:
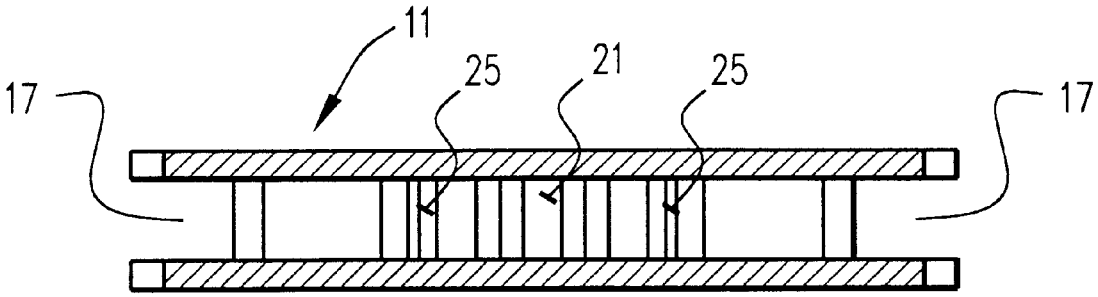

FIGS. 7 and 8 illustrate exemplary cross sections of the nozzle 10 just above, and substantially at, the receptacle 45. While in FIGS. 7 and 8 the receptacle 45 is illustrated as having a substantially rectangular cross section, as are the openings leading to the outlets 17, other cross sections can be provided. This includes oval (including racetrack) or other polygons besides rectangular.

Desirably the side walls 36, comprising part of the structure 20, which define the receptacle 45, are slanted toward the passages 25, or radiused. Also, the exterior portions 27 to that part of the structure 20 defining the receptacle 45 are slanted or (as shown in FIG. 3) radiused, to facilitated proper directing of the streams of molten metal through the outlets 17.

The outlets 17, 23 are preferably dimensioned, and positioned, with respect to the conduit 11, structure 20, each other, and the receptacle 45, so that about 55–80% (preferably about 60–70%) of the molten metal flowing through the passageway 14 exits the nozzle 10 through the outer outlets 17. Also, preferably about 20–45% (preferably about 30–40%) of the molten metal flowing through the passageway 14 exits the nozzle through the inner outlets 23.

Figure 9:
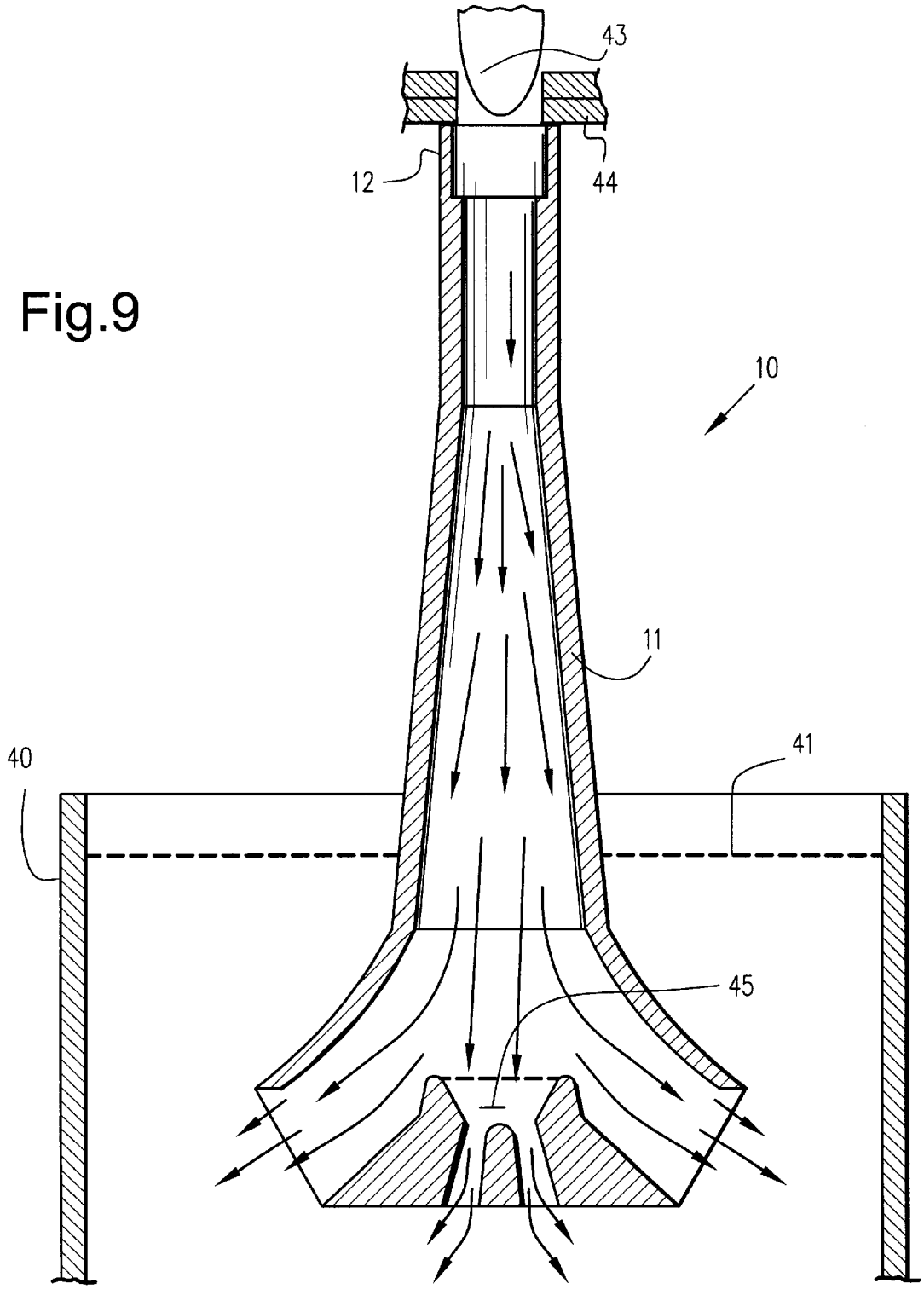
FIG. 9 is a schematic cross-sectional view of the nozzle of FIG. 3 shown positioned in a mould so that the outlets thereof are submerged (that is below the level of molten metal in the mould).

FIG. 9 schematically illustrates the nozzle 10 of FIGS. 1 through 8 utilized in a method of introducing molten metal (such as molten steel) into a mould 40 (such as a slab caster) having a liquid level 41 of molten metal established therein. The nozzle 10 is positioned in the vessel 40 (utilizing any conventional positioning mechanism) so that all of the outlets 17, 23 are below the liquid level 41, and then molten metal is introduced into the nozzle to flow downwardly. A conventional plug 43 may control the rate of flow of molten metal from a tundish 44, or other vessel, into the top 12 of the nozzle 10, and then into the mold 40 (or other vessel), of a slab caster. Then the molten metal is caused to form a molten pool 45, in the metal-receiving receptacle 45 illustrated in FIG. 3 above the inner outlets 23, and preferably above the center points 18 of the outer outlets 17, and substantially concentric with the passageway 14, so as to stabilize the flow of molten metal through the outlets 17, 23. Then the molten metal is caused to exit the outlets 17, 23, flowing into the vessel 40. The method is practiced so that about 55–80% (preferably about 60–70%) of the molten metal to exit the nozzle 10 exits through the outer outlets 17, and about 20–45% (preferably about 30–40%) is caused to exit through the inner outlets 23. Preferably the molten metal is caused to exit the inner outlets 23 at an angle b at about 70–80° to the horizontal, and exit the outer outlets 17 at an angle a of about 35–45° to the horizontal.

The method is also preferably practiced so as to cause the velocity of the molten metal exiting the inner outlets 23 to reduce significantly substantially immediately after exiting the nozzle 10 (e.g. by at least 50% compared to the velocity of the molten metal just prior to entering the receptacle 44), and causing molten metal streams exiting the two inner outlets 23 to recombine before reaching the bottom 46 of the vessel 40. The method is practiced so that molten metal streams exiting the inner outlets 23 do not merge with streams exiting the outer outlet 17, thereby providing more mixing of recently introduced molten metal with that already in the vessel 40. Also, the method is practiced so that the flow angle of the molten metal exiting the outlets 17, 23 substantially does not change upon increasing throughput (that is the angle through the outlet 17 is always between about 60–70° with respect to the horizontal in the preferred embodiment and is not variable based upon throughput) although the average velocity of the molten metal flow exiting the outlets 17, 23 increases substantially proportionally with the increase in throughput.

While the invention has been herein shown and described in what is presently conceived to be the most practical and preferred embodiment thereof it will be apparent to those of ordinary skill in the art that many modifications may made thereof within the scope of the invention, which scope is to be accorded the broadest interpretation of the appended claims so as to encompass all equivalent structures and methods.

What is claimed is:

1. A nozzle for guiding molten metal flowing from a vessel into a mould, the nozzle comprising a conduit which is elongate along an axis which is oriented substantially vertically during use, the nozzle having at least one upper inlet, at least two lower inclined outlets which are inclined to the axis, and at least one lower axial outlet located generally axially between the inclined outlets, the nozzle further comprising a receptacle located above said at least one lower axial outlet, the receptacle having an upper opening and being defined by sidewalls which are substantially parallel and/or which converge towards the lower extremity of the nozzle, the receptacle receiving a proportion of the molten metal flowing through the nozzle in use prior to such molten metal exiting the nozzle, the minimum combined cross-sectional area of the inclined outlets being at least twice as great as the minimum combined cross-sectional area of the at least one lower axial outlet.

2. A nozzle according to claim 1, in which, during use, at least 55% of the total molten metal flow exits the inclined outlets and no more than 45% of the total molten metal flow exits the at least one lower axial outlet.

3. A nozzle according to claim 2, in which, during use, at least 60% of the total molten metal flow exits the inclined outlets and no more than 40% of the total molten metal flow exits the at least one lower axial outlet.

4. A nozzle according to claim 1, in which the minimum combined cross-sectional area of the inclined outlets is at least three times as great as the minimum combined cross-sectional area of the at least one lower axial outlet.

5. A nozzle according to claim 1, in which the minimum combined cross-sectional area of the inclined outlets is at least four times as great as the minimum combined cross-sectional area of the at least one lower axial outlet.

6. A nozzle according to claim 1, in which the inclined outlets are downwardly inclined at an angle of 40°–60° to the nozzle axis.

7. A nozzle according to claim 6, in which the inclined outlets are downwardly inclined at an angle of 45°–55° east to the nozzle axis.

8. A nozzle according to claim 1, in which the at least one lower axial outlet widens towards the exit of the outlet.

9. A nozzle according to claim 1, in which there are at least two outlets located generally axially between the inclined outlets.

10. A nozzle according to claim 9, in which there are only two outlets located generally axially between the inclined outlets, located substantially symmetrically on opposite sides of the nozzle axis.

11. A nozzle according to claim 1, in which the at least one lower axial outlet is downwardly inclined at an angle of 0°–30° to the nozzle axis.

12. A nozzle according to claim 11, in which the at least one lower axial outlet is downwardly inclined at an angle of 5°–25° to the nozzle axis.

13. A nozzle according to claim 1, in which the inclined outlets have a substantially constant cross-sectional area along at least part of their length.

14. A nozzle according to claim 1, in which each outlet has a bore and in which each of the inclined outlets has a restriction substantially at its innermost extremity, beyond which, in a direction towards its outermost extremity, the bore of the outlet is wider than it is at the restriction.

15. A nozzle for guiding molten metal flowing from a vessel into a mould, the nozzle comprising a conduit which is elongate along an axis which is oriented substantially vertically during use, the nozzle having at least one upper inlet, and having at least two lower inclined outlets which are inclined to the axis, the nozzle further comprising a receptacle located above at least one generally axially located outlet and substantially axially between the inclined outlets, the receptacle having an upper opening and being defined by sidewalls which are substantially parallel and/or which converge towards the lower extremity of the nozzle, the receptacle receiving a proportion of the molten metal flowing through the nozzle in use prior to such molten metal exiting the nozzle.

16. A nozzle according to claim 15, in which at least two sidewalls of the receptacle converge towards the lower extremity of the nozzle.

17. A nozzle according to claim 15, in which the receptacle is defined by four sidewalls.

18. A nozzle according to claim 17, in which all four sidewalls of the receptacle converge towards the lower extremity of the nozzle.

19. A method of guiding molten metal flowing from a vessel into a mould, utilizing a nozzle according to claim 1.

20. A nozzle according to claim 15, in which the receptacle is located above two generally axially located outlets.

21. A nozzle according to claim 20, in which the minimum combined cross-sectional area of the inclined outlets is at least twice as great as the minimum combined cross-sectional area of the generally axially located outlets.

22. A nozzle according to claim 21, in which the minimum combined cross-sectional area of the inclined outlets is at least three times as great as the minimum combined cross-sectional area of the generally axially located outlets.

23. A nozzle according to claim 22, in which the minimum combined cross-sectional area of the inclined outlets is at least four times as great as the minimum combined cross-sectional area of the generally axially located outlets.

24. A nozzle according to claim 15, in which the inclined outlets are downwardly inclined at an angle of 40°–60° to the nozzle axis.

25. A nozzle according to claim 24, in which the inclined outlets are downwardly inclined at an angle of 45°–55° to the nozzle axis.

26. A nozzle according to claim 15, in which the at least one generally axially located outlet widens towards the exit of the outlet.

27. A nozzle according to claim 15, in which each generally axially located outlet is downwardly inclined at an angle of 0°–30° to the nozzle axis.

28. A nozzle according to claim 15, in which each generally axially located outlet is downwardly inclined at an angle of 5°–25° to the nozzle axis.

29. A method of guiding molten metal flowing from a vessel into a mould, utilizing a nozzle according to claim 15.

* * * * *